United States Patent [19]

Murata

[11] 4,112,825

[45] Sep. 12, 1978

[54] PRESSURE-REDUCING DEVICE

[75] Inventor: Hikaru Murata, Gifu, Japan

[73] Assignee: Kayabakogyokabushikikaisha, Tokyo, Japan

[21] Appl. No.: 579,436

[22] Filed: May 21, 1975

[51] Int. Cl.[2] ..... F15B 13/08

[52] U.S. Cl. ..... 91/447; 137/116.3

[58] Field of Search ..... 91/444, 447, 448, 446; 137/116.3

[56] References Cited

U.S. PATENT DOCUMENTS

| | | | |
|---|---|---|---|
| 3,455,209 | 7/1969 | Preston et al. | 91/447 |
| 4,020,867 | 5/1977 | Sumiyoshi | 91/446 |

*Primary Examiner*—William R. Cline

*Attorney, Agent, or Firm*—Saul Jecies

[57] ABSTRACT

A pressure-reducing device which incorporates, in a hydraulic actuating system provided with more than one circuit module, a flow rate control valve which is set at a lower flow rate value than the fluid supply rate from the hydraulic source and is installed in the supply side of a circuit module so as to control precisely the maximum working pressure of any of the said circuit modules thereby assuring that the maximum working pressure is at a value lower than the maximum pressure value set by a main relief valve installed in the fluid supply side leading from the hydraulic source. A relief valve is installed in the lower stream of the said flow rate control valve so as to control its maximum working pressure.

8 Claims, 6 Drawing Figures

13
14
11
12
18
12
19a
18a
13b
17a
10a
12
20a
21a
25b
69a
70a
26b
54a
54b
55a
55b
36a
40a
62a
52a
52b
62b
23
35a
39a
41b
41a
28a
58a
58b
20b
21b
27
16
22

PRESSURE-REDUCING DEVICE

BACKGROUND OF THE INVENTION

The present invention relates to a pressure-reducing device which may be used most satisfactorily in a case where, in relation to a hydraulic actuating system provided with more than one circuit module, a pressure lower than that set by a main relief valve is required for some of these circuit modules.

For example, in the case where an adjustment of the cylinder force is required for locking or clamping purposes and where it is impractical to adjust the main relief valve because of its relation to other circuit modules, the locking or clamping force was adjusted in the prior art by installing a pressure-reducing valve between the main circuit and the circuit concerned, so as to adjust its secondary pressure independently of the main circuit pressure.

In this case, the conventional pressure-reducing valve most commonly employed is of a construction that causes a spring or a pilot valve to be subjected to a pressure, and to a part of the flow rate related to the increase in the secondary pressure, so as to move a main spool which effects a reduction or a closing of the passage. In the case of such a pressure-reducing valve employed in the aforementioned locking or clamping circuit, therefore, the load pressure is normally low until just before the locking or clamping effect takes place and the spool, which is the pressure-reducing member of the pressure-reducing valve, is in the fully opened position in which it keeps the main circuit pressure at the same level as the load pressure. In this case, however, as soon as the locking or clamping effect takes place, a pressure increase takes effect which is detected by the pressure-reducing valve, which not only reduces its own effective cross-section in order to keep the secondary pressure at the set value, but also works to increase the main circuit pressure on the primary side so that it reaches the set pressure value of the main relief valve. Since the pressure-reducing valve generally starts to affect the main circuit flow from the secondary circuit after the load pressure reaches the set value, however, the pressure increase on the secondary side continues until the passage is fully closed. When it is fully closed, therefore, the pressure on the secondary side will become much higher than the set value, even though the passage may be closed very quickly.

SUMMARY OF THE INVENTION

Taking the prior art defects into account, the first purpose of the present invention is to provide a pressure-reducing device of unique construction without such defects as above mentioned.

Another purpose of the present invention is to offer a pressure-reducing device of a type particularly appropriate for use in cases where large capacities are to be controlled.

To achieve these purposes in the present invention, a flow rate control valve which is set at a lower flow rate value than that of the supply flow rate from a hydraulic source, and a relief valve which is installed in the lower stream of the flow rate control valve and which controls its maximum working pressure, are placed in the circuit module in the supply side circuit thereof so that the maximum working pressure may be set lower than the maximum pressure of the hydraulic source determined by the main relief valve. Thus, using the device of the present invention, the hydraulic actuating fluid derived from a hydraulic source is limited to a certain flow rate by means of the flow rate control valve. The maximum pressure of the hydraulic source, i.e., the primary side pressure, therefore, may rise to the pre-set pressure of the main relief valve that is installed at the hydraulic source side, independently of the relief valve installed at the pressure-reducing circuit side, while the maximum pressure of the secondary side of the pressure-reducing circuit may be set primarily by the relief valve installed in that section. Thus, the maximum working pressure of a pressure-reducing circuit, i.e., the secondary circuit side, can be set by means of a relief valve which, as a pressure control valve, has much better control characteristics than a pressure-reducing valve.

Furthermore, in the present invention, an amplification valve which affords a main flow rate that is amplified in proportion to a pilot flow rate, is employed as the pressure-reducing device so as to minimize the flow rate of the hydraulic actuating fluid returning to the reservoir side from the relief valve in order to control the maximum working pressure of the secondary side and to improve the efficiency of the total hydraulic actuating system. The flow rate control valve and the relief valve are installed, in the same manner as previously mentioned, in the said amplification valve. Since the pilot flow rate is normally very small as compared with the main flow rate, it is possible to minimize the flow rate of the hydraulic actuating fluid returning to the reservoir side from the relief valve of the secondary circuit side.

The abovementioned and other purposes, characteristics and performance of the present invention may be understood through the following descriptions of application examples which will be made with reference to the attached drawings.

DESCRIPTION OF THE PREFERRED EMBODIMENT

Figure 1:
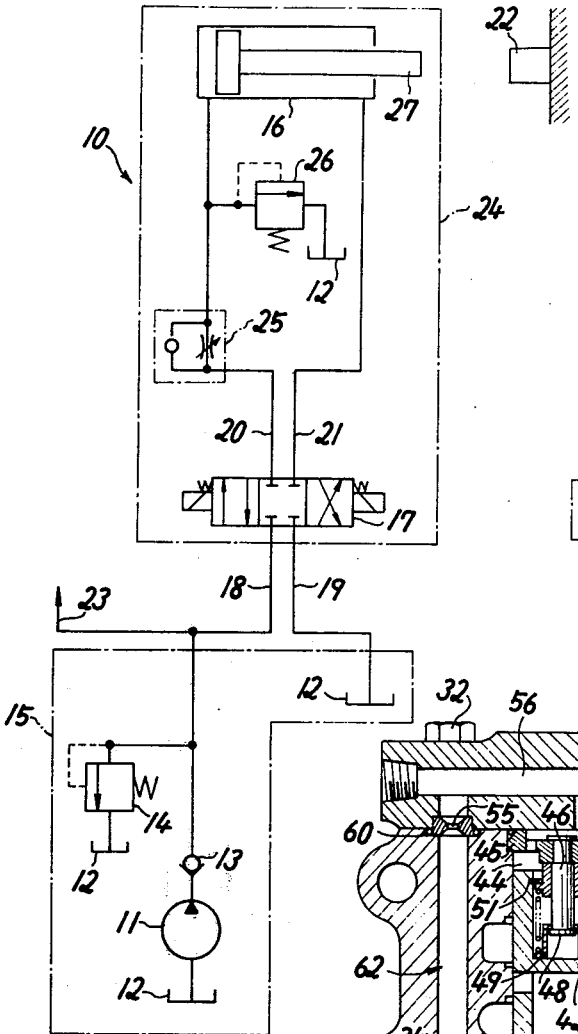
FIG. 1 represents a circuit diagram showing an application example of a pressure-reducing device constructed according to the present invention.

A fundamental circuit example of a hydraulic clamp 10 provided with the pressure-reducing device of the present invention is shown in FIG. 1.

A clamp cylinder 16, the actuator, is connected through ducts 18, 19, 20, 21 as well as a solenoid type 4-port 3-position direction switch valve 17 to the primary side circuit 15 which is provided with a pump 11, the hydraulic source, i.e. a tank 12, the reservoir, constituting a load check valve 13 and a main relief valve 14. In the actuating system for such a hydraulic clamp 10, when it is impractical to adjust the clamp cylinder 16 force acting on retainer member 22 by means of a main relief valve 14 because of its relation to some other circuit module 23, the adjustment is achieved by installing a pressure-reducing valve in a supply side duct 20 of the secondary side circuit 24 consisting of a direction switch valve 17 and the clamp cylinder 16, and by adjusting the setting of the secondary pressure by the said pressure-reducing valve. In the present invention, however, a pressure compensating flow rate control valve 25 is installed in place of the pressure-reducing valve and a relief valve 26 is installed in its lower stream, and the control flow rate of the said flow rate control valve 25 is set at a somewhat lower flow rate value than the actual supply flow rate from the pump 11.

Thus, according to the present invention, when the direction switch valve 17 is switched over to the left side position to allow the clamp cylinder 16 to extend, the hydraulic actuating fluid furnished to the clamp cylinder 16 side from the pump 11 is limited to a certain flow rate by means of the flow rate control valve 25. The delivery pressure of the pump 11, i.e., the primary side pressure, may rise to the pressure set by the main relief valve 14, independently of the relief valve 26 installed on the secondary circuit 24 side. On the other hand, when the secondary side pressure rises as piston rod 27 of the clamp cylinder 16 contacts the retainer member 22, the supply flow from pump 11 is returned from relief valve 26 to the tank 12 while being limited in its flow rate by means of the flow control valve 25, immediately after the secondary pressure exceeds the pressure set by the relief valve 26. Thus, the secondary side pressure, which determines the force exerted by the clamp cylinder 16, may be controlled primarily by the pressure set by the relief valve 26. In this case, since the relief valve 26 has much better pressure control characteristics than a conventional pressure-reducing valve of the type employed in the, the prior art peak pressure as well as the time required for dropping the secondary side pressure to the set value of the relief valve 26 may be reduced significantly.

A pressure-reducing device according to the present invention may be constructed on the basis of the above explanation. In cases where a pressure-reducing circuit of large capacity is required, however, the above embodiment is not very satisfactory since the relief valve 26 and the flow rate control valve 25 must be of a large size, corresponding to the large capacity of the circuit. In simultaneous operation with other circuit modules, the flow rate of the hydraulic actuating fluid returning to the tank 12 side from the relief valve 26 of the secondary side circuit 24 becomes uneconomical and, since the supply flow rate to the clamp cylinder 16 is limited by means of the flow rate control valve 25, single operation does not achieve higher speeds than does simultaneous operation.

Figure 2:
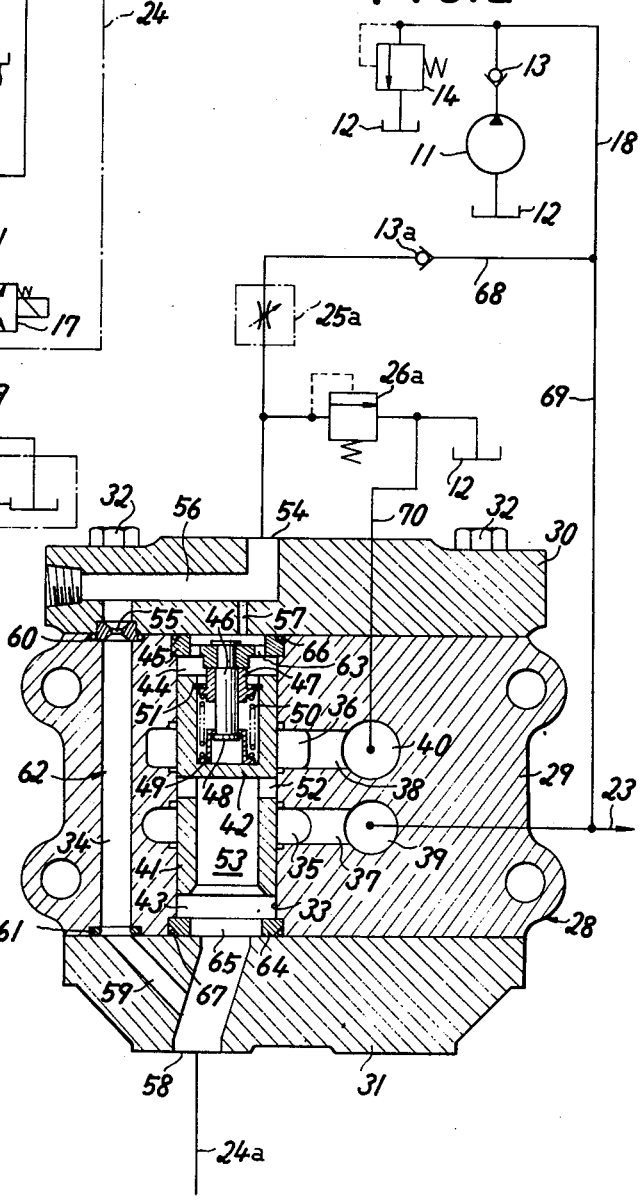
FIG. 2 represents a circuit diagram showing an example of a pressure-reducing device constructed according to the present invention, in combination with am amplification valve.

The fundamental construction of a pressure-reducing device appropriate for controlling such large capacities is shown in FIG. 2. According to FIG. 2, a flow rate control valve **25*a* is combined with a relief valve 26*a* for pilot use and with the pilot part of an amplification valve 28** which forms the hydraulic equivalent of a Wheatstone bridge.

In this embodiment the amplification valve 28 consists of the valve body 29 and upper and lower covers 30, 31 attached integrally thereby by means of bolts 32. The valve body 29 has a valve chamber 33 and a passage 34 penetrating it longitudinally in parallel, two annular grooves 35, 36 formed around the said valve chamber 33 and outer ports 39, 40 which lead to said two annular grooves 35, 36 through passages 37, 38, respectively, and are open to the exterior of the valve body 29. The valve chamber 33 incorporates a freely sliding valve spool 41, and chambers 43, 44 are separated by their central partition wall 42 at both ends of the valve chamber 33. Normally, the valve spool 41 is kept in the neutral position relative to the valve chamber 33. The end of chamber 44 in the valve chamber 33 is fitted with a bushing 45, and a guide rod 46 extending therefrom projects into valve spool 41. A center spring 50 is installed between a spring holder 47 fitted to the base of the said guide rod 46 and another spring holder 49 which is fastened to its head by means of a rim 48. Normally, spring holder 47 is in contact with a snap ring 51 fitted to the valve spool 41, while the lower end of the other spring holder 49 is in contact with the central partition wall 42 of the valve spool 41, so that the valve spool 41 is kept in a neutral position relative to the valve chamber 33 due to the restoring force of the center spring 50. A through hole 52 bored through the side walls of the valve spool 41 is always in communication with a chamber 43 through an inner passage 53 and, when the valve spool 41 is in the neutral position, the through hole is closed by the side walls of the valve chamber 33 so as not to connect to either of the annular grooves 35, 36. Thus, when the valve spool 41, shifts axially the through hole 52 opens selectively and connects to the said annular grooves 35, 36 to communicate the chamber 43 to one or the other of the outer ports 39, 40, depending on the direction of movement of the valve spool 41.

The cover 30 closing the top of the valve body 29 is provided with a passage 56, which opens at one end as a pilot port 54 to the upper surface and incorporates a detection orifice 55 at its other end. Passage 56 also incorporates a damper orifice 57 branching from it. The other cover 31 closing the botton incorporates an outer port 58 and a passage 59 branching from it. These passages 56, 59 are connected to passage 34 of the valve body 29 through seals 60, 61 installed in the junction section, respectively. Thus, the pilot passage 62, which is a bypass connecting the pilot port 54 at the surface of the cover 30 and the outer port 58 of the other cover 31 through the detection orifice 55, is completed by means of the said passages 34, 56, 59. The damper orifice 57 is connected to chamber 44 of the valve body 29 through a hole 63 bored in bushing 45; thus, the chamber 44 and the pilot passage 62 are connected to each other through the damper orifice 57. In addition, outer port 58 opens not only to the surface of the cover 31 but also to the valve chamber 33 of the said valve body 29 via a through hole 65 in packing holder 64; thus, the chamber 43 of the valve body 29 is communicated with the outside. The packing holder 64, like the bushing 45 of chamber 44 previously mentioned, is formed at the end of the other chamber 43, and they are held by the covers 30, 31 through seals 66, 67, respectively.

The pilot port 54 of the amplification valve 28 thus constructed is connected to the supply duct 18 of the hydraulic source by means of a duct 68, and a load check valve **13*a* and a flow rate control valve 25*a* are installed for pilot use in the path. A relief valve 26a for pilot use is also installed in their lower stream. Outer ports 39, 40 are connected to supply duct 18 and tank 12 of the said hydraulic source through ducts 69, 70, and another outer port 58 is connected to the secondary side pressure reducing circuit 24a**.

Thus, when the hydraulic actuating fluid is supplied by pump 11 from the hydraulic source, part of the fluid proceeds as a pilot flow from the pilot port 54 of amplification valve 28 to secondary side circuit 24a through pilot passage 62 and outer port 58. Detection orifice 55, installed in the path, causes a differential pressure by pressure reduction in the flow while detecting its flow rate. Then, the inflow side pressure of the detection orifice 55 is led to chamber 44 through damper orifice 57 and the pressure of chamber 43 becomes lower than that of the said chamber 44, corresponding to the pressure reduction of the pilot flow caused by the detection orifice 55. Thus, the valve spool 41 is thrust downwards to open hole 52 to the annular groove 35 and eventually to open the main passage leading from outer port 39 to outer port 58 through passage 37, annular groove 35, hole 52, inner passage 53 and chamber 43. The hydraulic actuating fluid from the pump 11, therefore, is divided appropriately into pilot and main flows, which merge at the outer port 58 and are supplied to the secondary side circuit 24a.

When the load pressure of the secondary circuit 24a rises to reach the pressure set by the pilot relief valve 26a, the pilot relief valve 26a starts operation to release part of the hydraulic actuating fluid in the pilot circuit to the tank 12. Since the pilot circuit is provided with a flow rate control valve 25a as its inlet, the pilot flow rate passing the detection orifice 55 is reduced as the relief valve 26a starts to operate. Thus, the differential pressure occurring in front of and behind the detection orifice 55 becomes lowered, allowing valve spool 41 to travel upwards due to center spring 50 and eventually to reduce the opening ratio of the through hole 52 to annular groove 35. Finally, as the complete pilot flow returns from relief valve 26a to tank 12, the differential in pressure in front of and behind the detection orifice 55 becomes zero and valve spool 41 returns to the neutral position (the position shown in FIG. 2), closing the main passage completely. As stated above, according to the present pressure-reducing device, the secondary side pressure is adjusted by the set pressure of the relief valve 26a installed in the pilot circuit. Namely, as the secondary side pressure approaches the set value, the pilot flow is bypassed, flowing partly to tank 12 and the difference in pressure occurring in front of and behind detection orifice 55 installed in the pilot passage 62 becomes reduced, enabling the valve spool 41 to move back to the neutral position, so that the opening of the hole 52 to the annular groove 35 or the opening area of the main passage and eventually the secondary side pressure may be reduced.

Figure 3:
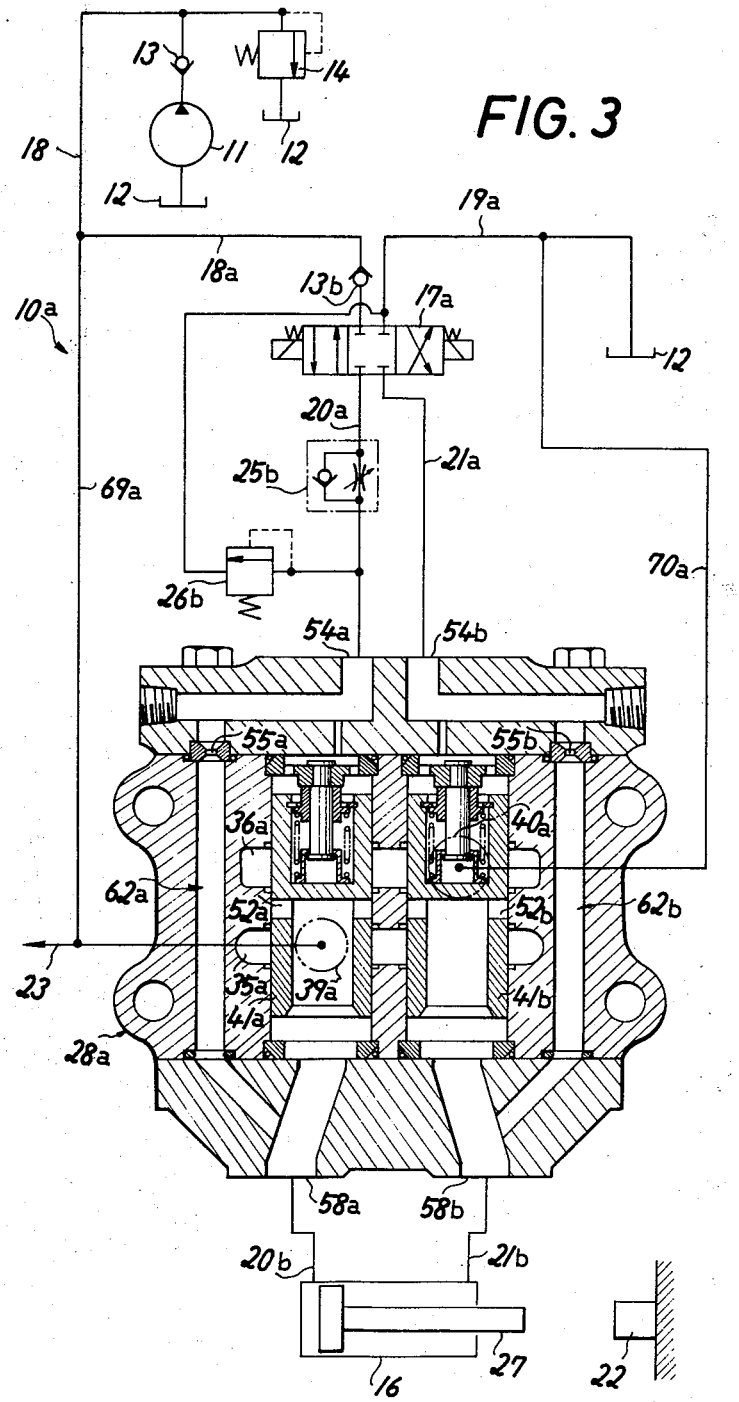
FIG. 3 represents a circuit diagram showing an embodiment in which a direction switch function is added to the device of FIG. 2.

FIG. 3 shows an example where the device of FIG. 2 has added to it a direction switch function and is employed as a hydraulic clamp 10a in the same manner as in the example of FIG. 1. In this embodiment, an amplification valve 28a is employed, which incorporates, with the exception of the common outer ports 39a, 40a, two pairs of valve spools 41a, 41b, pilot passages 62a, 62b and others. As shown in the figure, its two pilot ports 54a, 54b are made to connect selectively with supply duct 18 and tank 12 of the hydraulic source through ducts 18a, 19a, 21a, and a direction switch valve 17a, while a load check valve 13b for pilot use is installed in duct 18a and a flow rate control valve 25b and a relief valve 26b for pilot use are installed in another duct 20a. Outer ports 39a, 40a are connected to the said supply duct 18 and tank 12 through ducts 69a, 70a, and outer ports 58a, 58b are connected to both sides of a clamp cylinder 16 through ducts 20b, 21b.

Thus, when direction switch valve 17a is switched to the left side position, the hydraulic actuating fluid from pump 11 or the hydraulic source flows to the left side of the clamp cylinder 16 through pilot passage 62a and detection orifice 55a of the left side, and the left side valve spool 41a travels downwards, so that the hydraulic actuating fluid supplied to annular groove 35a from pump 11 through duct 69a and outer port 39a proceeds directly to the left side of the clamp cylinder 16 from the hole 52a. The return fluid from the clamp cylinder 16 flows initially to the tank 12 through pilot passage 62b and detection orifice 55b of the right side, enabling the valve spool 41b of the right side to move upwards and to open its hole 52b to annular groove 36a, so that the said return fluid may proceed from this hole 52b directly to tank 12 through annular groove 36a, outer port 40a and duct 70a. Thus, in this case, a flow rate control valve 25b and a relief valve 26b work to reduce the secondary pressure of the fluid supply to the left side of the clamp cylinder 16. When the direction switch valve 17a is switched to the right side position, the direction of the pilot flow is reversed from the case mentioned above. Namely, the two valve spools 41a, 41b move in the reverse direction without effecting any pressure reduction at all.

A pressure-reducing device of the present invention constructed in combination with such an amplification valve as mentioned above has the following advantages.

Since a flow rate control valve 25a or 25b and a relief valve 26a or 26b are installed in the pilot circuit, rather small sized units may be used even if the control circuit must be of a large capacity. Furthermore, in cases where the circuit module is operated simultaneously with other circuit modules, the return flow rate from the relief valve to the tank may be minimized.

The opening area of hole 52 or 52a of the valve spool 41 or 41a to annular groove 35 or 35a is controlled automatically during the operation and is always of a size related to the flow rate supplied from the hydraulic source of the primary side. Namely, despite the fact that the opening area of the main passage can be controlled to the maximum opening required, it is small as compared with that of conventional pressure-reducing valves, so that any over-supply of fluid from the primary side to the secondary side occurring in the time period from the start of the pressure-reducing operation until the hole 52 or 52a is closed, may be minimized. Thus, the peak pressure may be kept low, since the pressure of the secondary side is prevented, to the maximum extent possible, from exceeding the set pressure of relief valve 26a or 26b.

The secondary side pressure increment over the set value of the relief valve 26a or 26b caused by over-supply may be dropped quickly to the set value if the capacity of the relief valve 26a or 26b is specified to be larger than the quantity [Control flow rate of the flow rate control valve 25a or 25b + Pilot flow rate required for the switching action of the valve spool 41 or 41a of the amplification valve 28 or 28a (hereinafter referred to as "control flow rate of the valve spool")] and if the secondary circuit is also connected to the tank side as the valve spool 41 or 41a travels upwards. Namely, when the control flow rate of the valve spool is taken to be Q, the capacity of the relief valve 26a or 26b is taken to be larger than 2Q and the control flow rate of the flow control valve 25a or 25b is taken to be equal to or somewhat greater than Q, the operation of the amplification valve 28 or 28a is controlled automatically by the flow rate Q during the normal operation. As previously mentioned, when the pressure-reducing operation is started by a rapid increase in the load pressure on the secondary side, the fluid over-supplied to the secondary side during the closure of the main passage works to raise the secondary side pressure over the set value of relief valve 26a or 26b. At the same time, the pilot flow entering from the primary side, while being controlled by the flow rate control valve 25a or 25b, is returned in its entirety from the relief valve 26a or 26b to the tank side. For this reason, the flow at the detection orifice 55 or 55a part not only becomes zero with the operation of relief valve 26a or 26b, but also a reverse flow occurs, returning from the secondary side to the tank side through the detection orifice 55 or 55a and relief valve 26a or 26b. Thus, the differential pressure in front of and behind the detection orifice 55 or 55a becomes higher at the secondary side and valve spool 41 or 41a not only acts to close the main passage leading to the secondary side from the primary side, but also travels further upwards so as to open hole 52 or 52a to the annular groove 36 or 36a and eventually to connect the secondary side to the tank, so tht the pressure increment caused by the over-supply may be eliminated quickly. Of course, the pressure increment over the set value caused by over-supply varies considerably according to the capacity of the hydraulic source of the primary side and the actuator of the secondary side. In the case where the pressure increment is small, it may be reduced to the set value by simply releasing the over-supply from pilot passage 62 or 62a. In the case where it is large, it may be reduced to the set value by forming a main passage which connects the secondary side with the tank.

A fourth advantage lies in the flow rate control mechanism which is referred to as the flow rate control valve 25a, 25b. Generally, duct resistance pressure P is almost proportional to the square of the flow rate Q; i.e., [$P = K.Q^2$]. If the capacity of the relief valve 26a or 26b is taken to be somewhat larger than the control flow rate of the valve spool, which is determined by the size of the detection orifice 55 or 55a in the present pressure-reducing circuit, the flow rate control mechanism is not required to be a valve of the full pressure-compensating type, so that a throttle valve or a simple fixed orifice valve may also be employed satisfactorily. In cases where the pressure difference between the primary side and the secondary side is small, the total duct area from the circuit junction section on the primary side to the relief valve 26a or 26b is selected appropriately, and the pressure loss in the pilot flow rate is minimized during the normal operation so that no trouble is caused in the pilot passage 62 or 62a and so that, when the relief valve 26a or 26b starts to act due to the pressure increment at the secondary side, a duct resistance may be produced with increasing pilot flow rate. The pressure difference between the primary side and the secondary side may be obtained from the characteristics of $P = K.Q^2$ and control may be excercized without using a large bypass flow rate. As stated above, by setting the capacity of the relief valve 26a or 26b to be larger to some extent than the control flow rate of the valve spool, not only may valves of very low cost be employed as the flow rate control members without any adverse effects on the pressure-reducing characteristics, but also the pilot flow rate may be set to be very small compared with the supply flow rate from the hydraulic source of the primary side.

Figure 4:
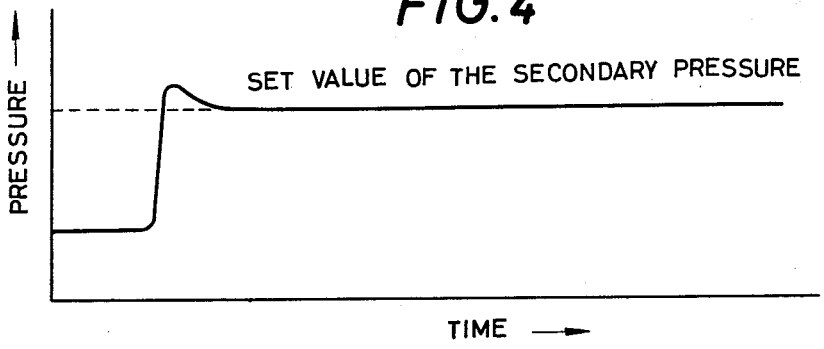
FIG. 4 shows a graph of the dynamic characteristics of a pressure-reducing device constructed according to the present invention.

The dynamic characteristics of a pressure-reducing device constructed according to the present invention are shown in FIG. 4 for reference.

Figure 5:
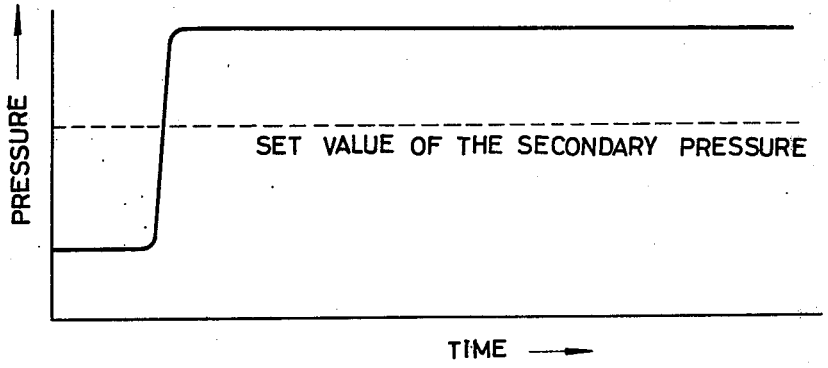
FIG. 5 shows a graph of the dynamic characteristics of a conventional pressure-reducing device provided with a pressure-reducing valve of the direct operation type.
Figure 6:
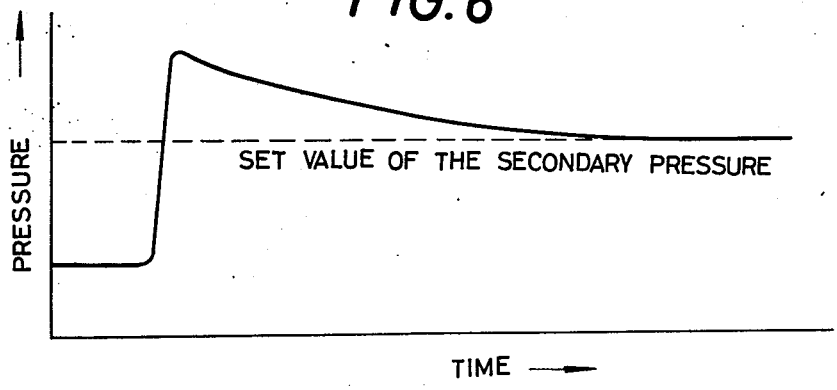
FIG. 6 shows a graph of the dynamic characteristics of a conventional pressure-reducing device provided with a pressure-reducing valve of the pilot operation type.

FIG. 5 shows a graph of the dynamic characteristics in the case where a pressure-reducing valve of the direct-operation type is employed. Namely, simultaneously with the start of the locking or clamping, the circuit pressure starts to rise and, as soon as it exceeds the set value, the pressure-reducing valve starts operation to intercept the flow through the passage. Since the circuit pressure continues to rise until the passage is fully closed, however, its secondary pressure generally exceeds the set value. Being of the direct operation type, it seals at the pressure level at the stage of interception and gives no peaks on the curve, however, the actual secondary pressure becomes much higher than the set value and varies considerably according to such changing conditions as the supply flow rate from the pump, pressure differences between the primary and the secondary sides, capacity of the secondary side and temperature of the actuating fluid. FIG. 6 shows a graph of the dynamic characteristics in the case where a pressure-reducing valve of pilot operation type is employed. In this case, although the secondary pressure of the pressure-reducing valve increases to exceed its set value after the start of the locking or clamping in the same manner as in the case of the pressure-reducing valve of the direct operation type previously mentioned, the secondary pressure drops to its set value with the passage of time as the hydraulic fluid is continuously released from a pilot poppet valve to the outside drain due to the interception of the flow in the passage. Nevertheless, not only does the time required for dropping the secondary pressure to the set value vary considerably according to various conditions, but also its peak pressure is generally rather high.

What is claimed is:

1. A hydraulic control circuit, comprising a user having a primary side and a secondary side;

a source of hydraulic fluid;

fluid supply conduit means connecting said source with said primary side of said user;

a pump in said conduit means for supplying hydraulic fluid under pressure from said source to said primary side of said user at a first flow rate;

pressure compensating flow rate control valve means in said conduit means intermediate said pump and said user and operative for limiting the fluid flow to said primary side of said user to a second flow rate which is smaller than said first flow rate; and relief valve means interposed in said conduit means between said control valve means and said user and communicating with said source, said relief valve means responding to pressure increase at said secondary side of said user by shunting the fluid flow from said pump back to said source so as to thereby control the maximum working pressure of said control valve means and reduce the pressure of said secondary side to the pressure limit given by the setting of said relief valve means.

2. A hydraulic control circuit as defined in claim 1, wherein said control valve means comprises an adjustable control valve.

3. A hydraulic control circuit as defined in claim 1; further comprising a shunting conduit which communicates said source with said conduit means intermediate said control valve means and said user and in which said relief valve means is interposed.

4. A hydraulic control circuit as defined in claim 1, wherein said control valve means comprises an amplification valve.

5. A hydraulic control circuit as defined in claim 4, wherein said amplification valve acts as a hydraulic equivalent of a Wheatstone bridge.

6. A hydraulic control circuit as defined in claim 4, wherein said amplification valve comprises means for connecting a secondary side supply circuit with said source when secondary side pressure rises beyond a determined value.

7. A hydraulic control circuit as defined in claim 4, wherein said control valve means comprises a throttle valve.

8. A hydraulic control circuit as defined in claim 4, wherein said control valve means comprises a fixed orifice.

* * * * *